US010969137B2

(12) United States Patent
Magyari

(10) Patent No.: US 10,969,137 B2
(45) Date of Patent: Apr. 6, 2021

(54) DORMER VENT COVER

(71) Applicant: Dormer Shield, Inc., Palmdale, CA (US)

(72) Inventor: Gabor Magyari, Palmdale, CA (US)

(73) Assignee: Dormer Shield, Inc., Palmdale, CA (US)

( * ) Notice: Subject to any disclaimer, the term of this patent is extended or adjusted under 35 U.S.C. 154(b) by 655 days.

(21) Appl. No.: 15/797,922

(22) Filed: Oct. 30, 2017

(65) Prior Publication Data

US 2018/0119986 A1 May 3, 2018

Related U.S. Application Data

(60) Provisional application No. 62/415,372, filed on Oct. 31, 2016.

(51) Int. Cl.

| | |
|---|---|
| ***F24F 13/20*** | (2006.01) |
| ***E04B 1/70*** | (2006.01) |
| ***E04B 1/78*** | (2006.01) |
| ***E04D 13/17*** | (2006.01) |

(52) U.S. Cl.

CPC ..... *F24F 13/20* (2013.01); *E04B 1/70* (2013.01); *E04B 1/78* (2013.01); *E04D 13/17* (2013.01)

(58) Field of Classification Search

CPC .... F24F 13/20; E04B 1/70; E04B 1/78; E04B 13/17; F16B 5/0208; F16B 37/041; F16B 37/02; F16B 37/046; Y10S 403/07; Y10S 403/97

USPC ..... 454/367, 368; D23/386

See application file for complete search history.

(56) References Cited

U.S. PATENT DOCUMENTS

| | | | | | |
|---|---|---|---|---|---|
| 1,975,686 | A | * | 10/1934 | Froelich | F24F 13/06 454/307 |
| 2,127,072 | A | * | 8/1938 | Tinnerman | B60K 11/04 24/453 |
| 2,168,676 | A | * | 8/1939 | McGrew | E01B 9/486 238/349 |
| 2,378,684 | A | * | 6/1945 | Carlstrom | F16B 37/02 411/523 |
| 2,834,278 | A | * | 5/1958 | Crute, Jr. | E04B 1/7076 454/276 |
| 3,130,659 | A | * | 4/1964 | Compton | E06B 7/02 454/276 |

(Continued)

OTHER PUBLICATIONS

Zeigh, "Cover in Front of Dormer Vent" internet web post of Mar. 28, 2015 downloaded on Jun. 7, 2020 at https://www.diychatroom.com/f9/cover-front-dormer-vent-254834/ (Year: 2015).*

*Primary Examiner* — Kenneth J Hansen
*Assistant Examiner* — Phillip Decker
(74) *Attorney, Agent, or Firm* — Socal IP Law Group LLP; Nikki Dossman; Mark Goldstein

(57) ABSTRACT

There is disclosed a dormer vent covering device including a dormer vent cover and an attachment device. The dormer vent cover includes a face, wherein the face is sized to cover a portion of an opening of a dormer vent, and a lip extending substantially perpendicularly from a portion of an outer edge of the face, wherein the lip is shaped to correspond to an outer shape of the dormer vent. The attachment device is detachably attachable to both the dormer vent and the dormer vent cover to attach the dormer vent cover to the dormer vent.

17 Claims, 4 Drawing Sheets

(56) References Cited

U.S. PATENT DOCUMENTS 3,426,818 A * 2/1969 Derby ..... F16B 37/041 411/175
4,502,368 A * 3/1985 Hempel ..... F24F 13/00 248/222.41
4,728,235 A * 3/1988 Patti ..... F16B 2/065 411/174
4,798,507 A * 1/1989 Olah ..... F16B 37/041 411/175
5,213,543 A * 5/1993 Clarino ..... F24F 13/20 292/253
D355,354 S * 2/1995 Sterling ..... D8/382
5,827,026 A * 10/1998 Patti ..... F16B 2/065 411/174
6,006,414 A * 12/1999 Corporon ..... F16B 37/041 29/525.02
6,575,827 B1 * 6/2003 Rutler ..... F24F 13/085 454/289
7,040,979 B1 * 5/2006 Betz ..... E04B 1/7076 454/271
7,651,390 B1 * 1/2010 Profeta ..... F24F 13/06 454/284
8,002,013 B2 * 8/2011 Brown ..... F24F 13/14 160/351
8,216,034 B1 * 7/2012 Sona ..... F24F 13/085 454/275
8,460,075 B2 * 6/2013 Mavroudis ..... F24F 13/084 454/275
8,528,271 B1 * 9/2013 Hemmer ..... E04D 13/004 52/101
9,249,982 B2 * 2/2016 Brown ..... F24F 13/14
9,435,561 B2 * 9/2016 Bowen ..... F24F 13/20
10,473,358 B2 * 11/2019 Breed ..... F24F 13/082
2002/0069599 A1 * 6/2002 Dhallan ..... F24F 13/20 52/302.1
2011/0247398 A1 * 10/2011 Breed ..... G01M 3/26 73/40.5 R
2011/0250833 A1 * 10/2011 Breed ..... F24F 13/082 454/275
2013/0291440 A1 * 11/2013 Herlihy ..... F24F 13/20 49/463
2014/0170962 A1 * 6/2014 Carter ..... F24F 13/082 454/367

* cited by examiner

FIG. 1C
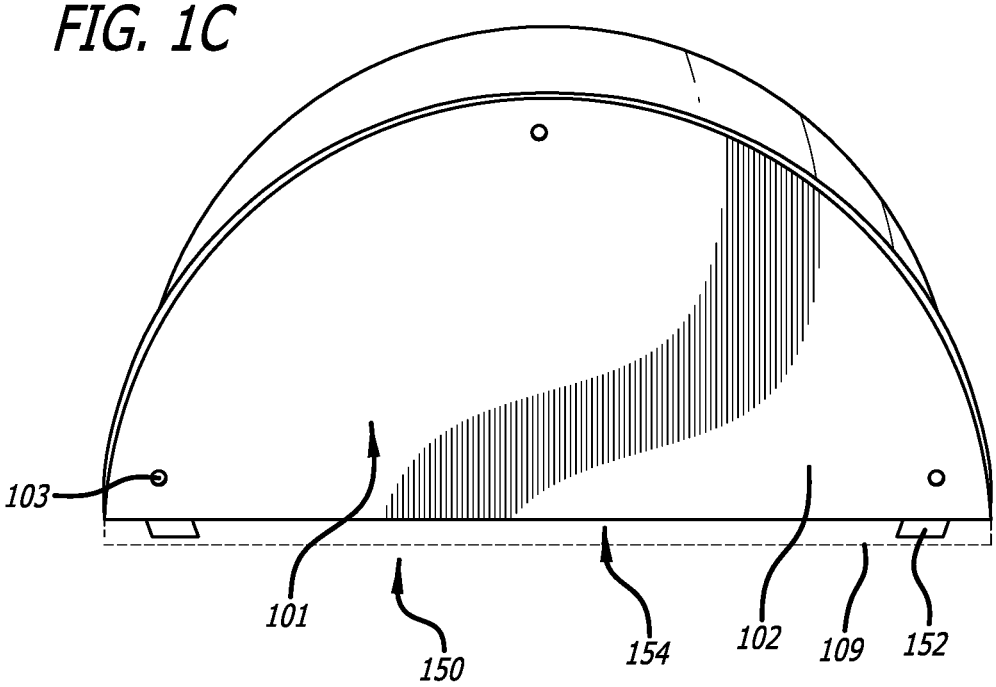
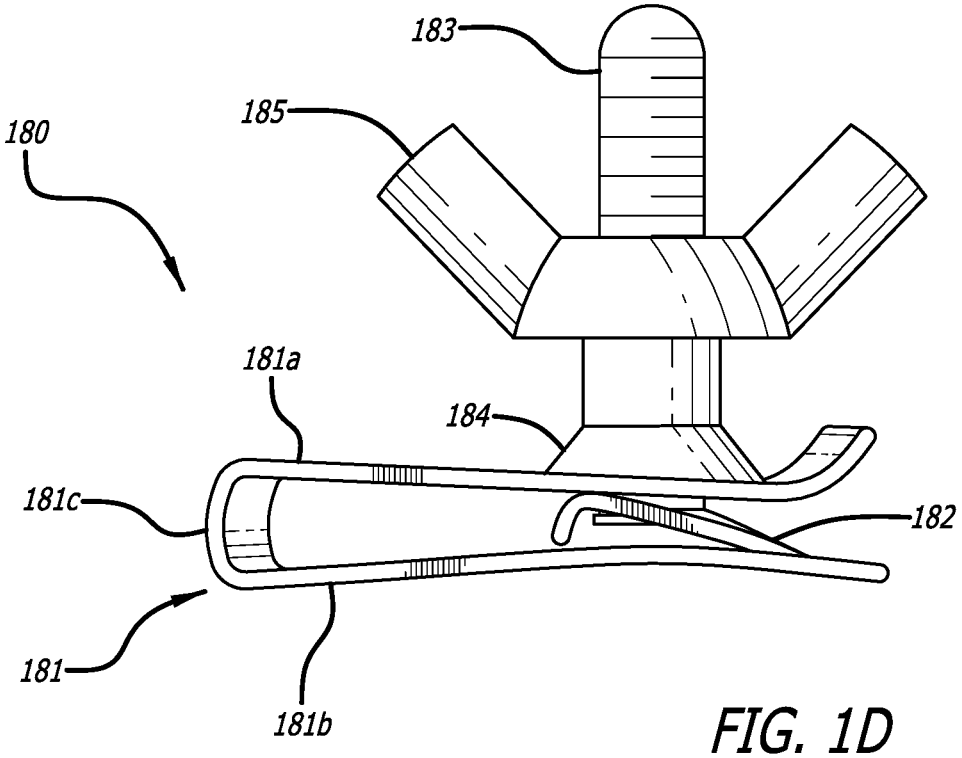
FIG. 1D

FIG. 1E
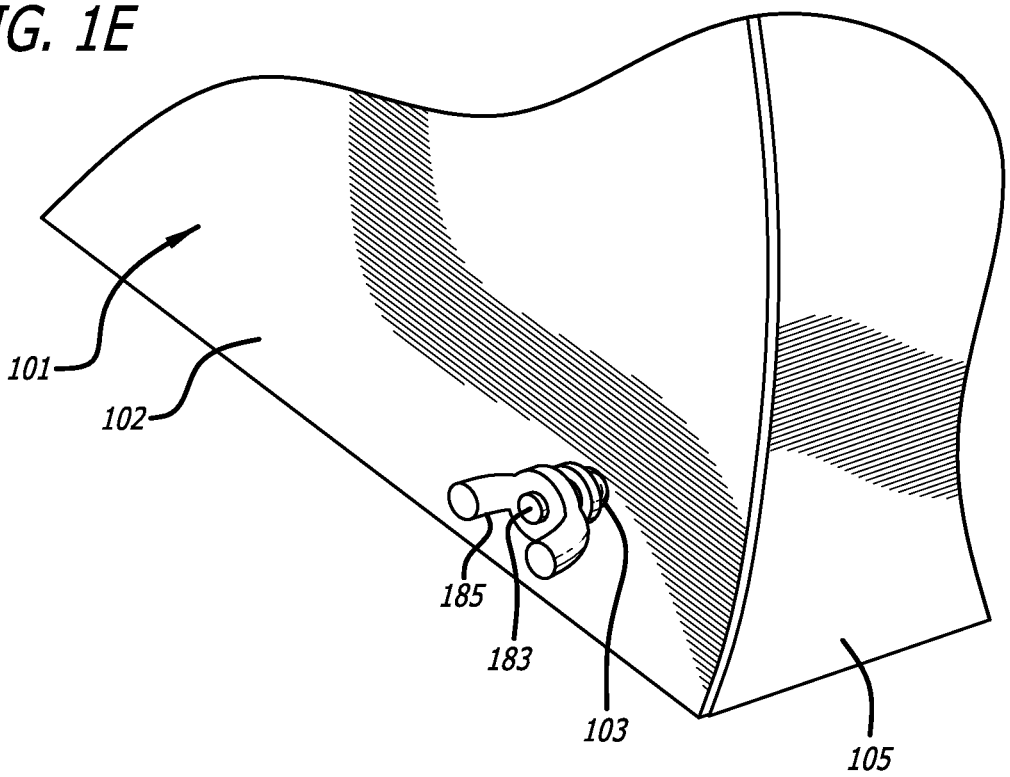
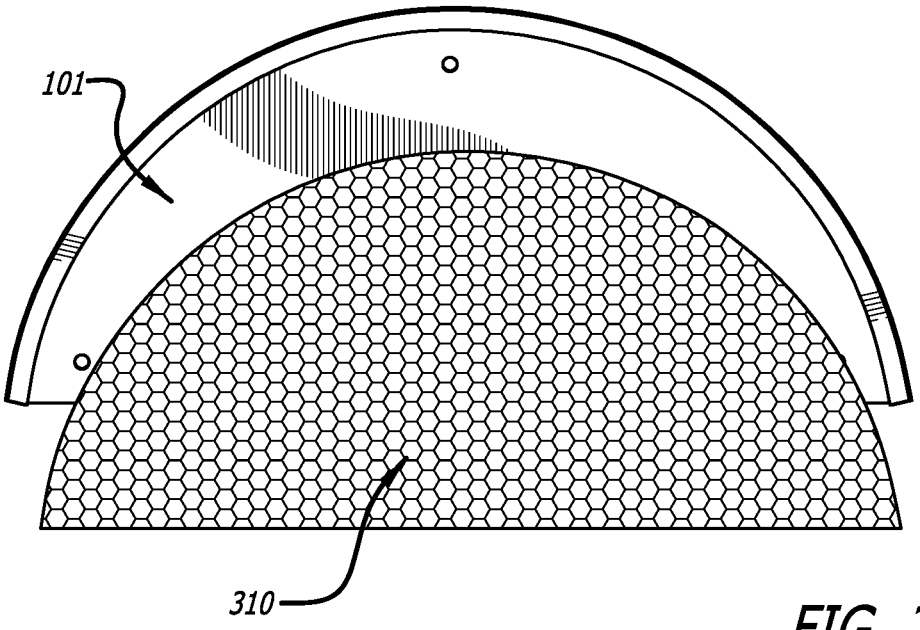
FIG. 2

FIG. 3
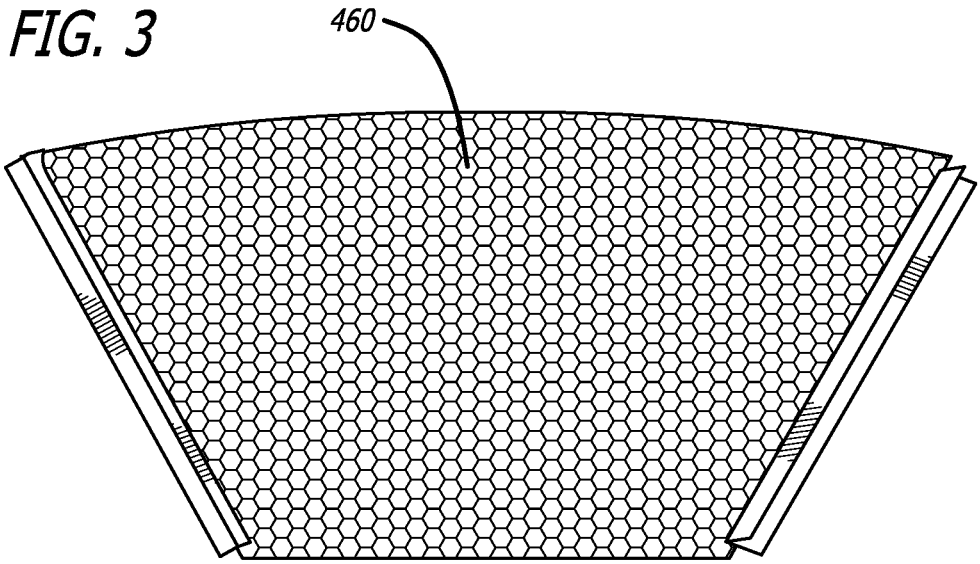
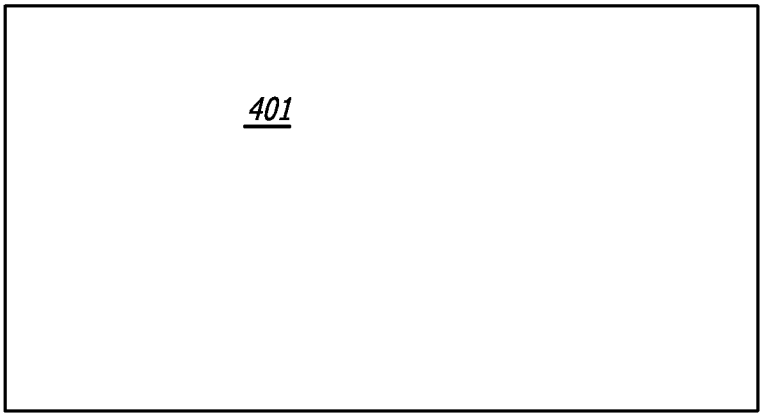
FIG. 4

DORMER VENT COVER

RELATED APPLICATION INFORMATION

This patent application claims priority from provisional patent application No. 62/415,372 filed Oct. 31, 2016 which is incorporated by reference in its entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a dormer vent cover.

DESCRIPTION OF THE DRAWINGS

FIG. 1C is a front view of the dormer vent cover of FIG. 1A on the dormer vent of FIG. 1B.

FIG. 1D is a perspective view of an attachment device.

FIG. 1E is a partial front view of the installed dormer vent cover of FIG. 1A.

FIG. 2 is a back view of an insulating panel being positioned in the dormer vent cover of FIG. 1A.

FIG. 3 is a front view of an insulating blanket.

FIG. 4 is a front view of another dormer vent cover.

DETAILED DESCRIPTION

Dormer vents on a building's roof allow for hot air to be released from an attic of the building during hot weather. However, during cold, stormy, snowy, or other inclement weather, water, sleet, ice, or other undesired types of moisture can enter the attic through dormer vents. Further, it may desirable to lessen or prevent loss of hot or warm air from the attic during cold weather.

Dormer vent covers described herein are used to cover dormer vents. The dormer vent covers can reduce heat loss and prevent moisture from entering the attic during cool or wet weather. These dormer vent covers can be easily removably installed or installed "tool-free", either by an individual resident, roofing contractor or handyperson.

Reducing or preventing moisture intrusion into an attic can be desirable for preventing or reducing moisture accumulation in the attic, which could result in damage to materials in the attic and the building below. During windy, wet weather, moisture can be blown through uncovered dormer vents, such that a damaging amount of moisture can build up in the attic space. A dormer vent cover installed on the dormer vent can prevent or reduce moisture entering the attic.

Reducing heat loss in cold weather conditions can be desirable for maintaining a suitable temperature in a building attic with dormer vents. Further, if the temperature in the attic drops too low, water lines in the attic can freeze, which can potentially cause them to burst. A dormer vent cover installed on a dormer vent can reduce air flow out of the attic, such that heat from the building is retained in the attic, which maintains the temperature throughout the entire building. The retained heat can maintain the temperature of the attic at a level to prevent or reduce the likelihood of the water lines freezing.

Reducing or preventing debris and pests from entering an attic can be desirable to help keep the attic and items located in the attic from becoming dirty. For example, during windy weather, dirt, sand, insects, and plant materials can be blown through the dormer vent into the attic. A dormer vent cover installed on a dormer vent can reduce or prevent intrusion of these unwanted items in the attic.

Further, an insulating panel can be installed in conjunction with the dormer vent cover to further reduce transfer of heat out of the attic. For example, the insulating panel can be formed of an insulating material that reduces heat transfer. The insulating panel can be installed between the dormer vent and the dormer vent cover, such that the dormer vent cover holds the insulating panel in place.

Figure 1A:
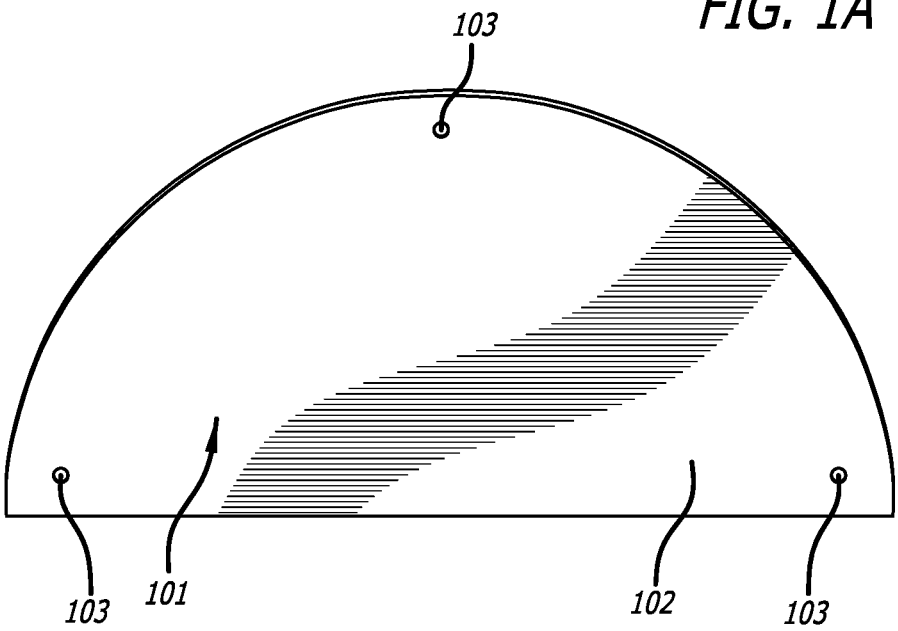
FIG. 1A is a front view of a dormer vent cover.

FIGS. 1A and 1E show a dormer vent cover 101 with openings 103 that can be installed on a dormer vent. The dormer vent cover 101 includes a substantially planar face 102 and a lip 105 extending substantially perpendicularly from the planar face. The dormer vent cover 101 can be formed of one or more suitable materials, such as steel, aluminum, plastic, acrylic, wood, resin, rubber, etc.

Figure 1B:
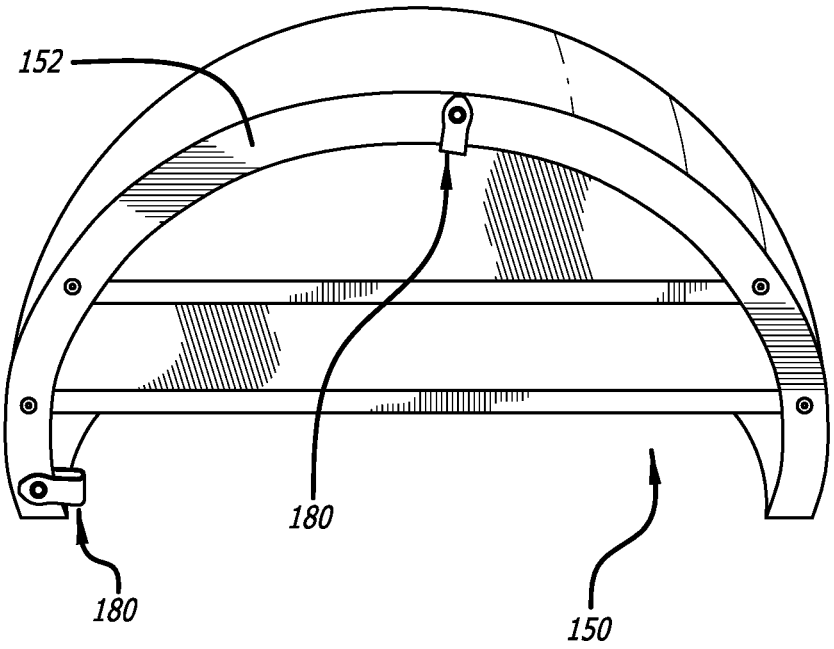
FIG. 1B is a front view of a dormer vent.

FIG. 1B shows a dormer vent 150 with a dormer vent edge 152. Attachment devices 180, also shown in FIG. 1D, can be used to install the dormer vent cover 101 by attaching it to the dormer vent edge 152. The attachment devices 180 can be attached to the dormer vent edge 152, for example, via a friction fit, a spring, or can be attached via one or more screws. The attachment devices 180 can then be detachably attached to the dormer vent cover 101. The attachment devices 180 can include extruded threaded "U" clips. The attachment device 180 can be formed of one or more suitable materials, such as steel, aluminum, plastic, acrylic, resin, etc.

As shown in FIG. 1D, attachment device 180 includes a "U" clip 181 with a first leg 181*a* and an adjacent second leg 181*b* that are coupled by a u-shaped hinge 181*c*. In an example, the attachment device can be formed of a continuous strip of metal formed as an extended "U" shape. A fastening device 183, such as a screw, peg, clip, or other suitable fastening device, can extend from the first leg 181*a*. For example, the fastening device 183 can be a screw or threaded bolt that is positioned in a threaded hole 184 in the first leg 181*a* such that the fastening device 183 extends substantially perpendicularly from the first leg 181*a*. The fastening device 183 can be fixed in the threaded hole via any suitable means, such as a friction fit, adhesive, glue, or epoxy. In an example, a fixing device 185, such as a hex nut, wing nut, or any other suitably kind of nut, can be threaded onto the fastening device 183 once the fastening device has been received by opening 103 to detachably attached the attachment device 180 to the dormer vent cover 101. Second leg 181*b* can include a spring 182, where the spring can be a separate piece or can be formed of a part of second leg such that the spring extends into a space between the second leg and the first leg 181*a*.

Attachment device 180 can be detachably attached on the dormer vent edge 152 by pushing the "U" clip onto the dormer vent edge such that second leg 181*b* is on an interior surface of the dormer vent edge and first leg 181*a* is on an exterior surface of the dormer vent edge. When installed, the dormer vent edge is positioned between first leg 181*a* and second leg 181*b*, and spring 182 presses against the interior surface of the dormer vent edge to keep the attachment device 180 in place. One or more attachment devices, such as two, three, four, or five attachment devices, can be positioned about the dormer vent edge to correspond to openings 103 in the dormer vent cover 101, as shown in FIG. 1E.

FIG. 1C shows the dormer vent cover 101 positioned on the dormer vent 150. The dormer vent cover 101 can be shaped such that a portion 154 of the dormer vent 150 remains open. The open portion 154 can allow a reduced air flow, as compared to the uncovered dormer vent 150, to prevent or reduce moisture or odor buildup in the attic. The portion 154 can be any suitable size, such as having a height of from a quarter of an inch to 4 inches. An optional screen 109 (shown in dashed line) can be positioned such that it covers the open portion 154 to prevent insects, rodents, and other pests from entering. The screen can be attached to the dormer vent cover 101.

FIG. 1E shows a dormer vent cover 101 with a fixing device 185. For installation of the dormer vent cover 101, the attachment devices 180 are positioned on the dormer vent edge 152 such that the attachment devices 180 align with the openings 103 of the dormer vent cover 101. Three openings 103 in the dormer vent cover 101 are shown in FIG. 1, such that three attachment devices 180 would be installed accordingly on the dormer vent edge 152. Other suitable numbers of openings 103 and attachment devices 180 can be used, such as between one and ten devices and corresponding openings.

The dormer vent cover 101 can then be positioned on the dormer vent 150, such that a lip 105 contacts and extends around an outer edge of the dormer vent 150. The cover lip 105 can help to keep the dormer vent cover 101 in place before it is fastened to the dormer vent 150. In one example, the fastening device 183, such as a screw, of an installed attachment device 180 can be inserted through the openings 103. The fixing device 185 can then be threaded onto the fastening device 183 to prevent the dormer vent cover 101 from slipping off the dormer vent 150. One or more washers can be used to adjust the fit, such as to prevent the fixing device 185 from undesirably loosening or slipping through the opening 103. Due to the orientation of the lip 105 against an outer edge of the dormer vent 150 and the attachment device against an inner edge of the dormer vent 150, the dormer vent cover 101 is held firmly in place so that it cannot slip or be blown off by wind.

In another example, one or more attachment device with open holes, such as threaded holes, can be positioned about a dormer vent edge 152 to align with openings 103. Another fastening device, such as a thumb-screw, can be inserted through the openings 103 and threaded into the open threaded holes. The fastening device can be turned or tightened by hand to engage the threads of the threaded open hole of the attachment device. Any suitable fastening device can be used, such as a screw with a round head, a screw with a knurled head, a friction-fit peg, and a screw with a head for use with a flat-head screwdriver, a Philips screwdriver, or a hex screwdriver.

Though the dormer vent cover is shown in the pictures as being a portion of a circle, the dormer vent cover can be any suitable size and shape to fit dormer vents of various sizes and shapes, such as ovals, rectangles (e.g., rectangle 401 in FIG. 4), squares, or other multi-sided irregular or regular shapes. For example, the dormer vent covers can be sized to fit either 18 inch or 24 inch semi-circular dormer vents.

The dormer vent cover can have functional or decorative cut-outs, such as stars, circles, diamonds, etc., to allow airflow or add aesthetic appeal. The dormer vent cover can be coated, such as with paint, enamel, or any other coating, or can be left uncoated. Stickers or other decorations can be applied to the dormer vent cover.

The lip can be various depths to accommodate different dormer vent dimensions. For example, the lip can have a depth from half an inch to eight inches. Further, the dormer vent cover can be formed with a deeper lip to provide additional protection for extreme wind and weather. The depth of the lip may vary along the perimeter of the dormer vent to accommodate the structure on which the dormer vent is installed, for example, the roof or the wall, or to facilitate installation or function.

FIG. 2 shows an insulating panel 310 that can be positioned between the dormer vent 150 and the dormer vent cover 101 as an insulator to prevent or reduce loss of heat from the attic. The insulating panel may be kept in place via a friction fit or may be pre-attached to the dormer vent cover 101 by glue, tape or other attaching technique. The insulating panel can be one or more of any suitable insulating material, such as expanded polystyrene foam board, cellulose foam board, or other insulating board. The insulating panel may be ½ or ¾ inches thick; in addition, thicknesses from ¼ to 1.25 inch may be used in various implementations. The insulating board may be wrapped in reflective insulation or may include reflective insulation on the side facing the dormer vent.

FIG. 3 shows an insulating blanket 460. The insulating blanket 460 may optionally be used in conjunction with the dormer cover and insulating panel. The internal insulating blanket covers the internal attic side of the dormer. The insulating blanket may be an aluminum bubble foil insulation blanket, recycled cotton insulation blanket, vinyl faced fiberglass insulation blanket, double reflective insulation and the like. The internal insulating blanket 460 is ½ inch to 4" thick. The internal insulating blanket 460 may include tape (double sided or incorporated)

The dormer cover, insulating panel and insulating blanket may be provided as a kit with fastening devices and clips for installation on a dormer, including tape for attaching the insulating panel to the dormer cover and/or tape for attaching the insulating blanket to the attic interior of the dormer. As described above, the dormer cover may be provided with the insulating panel pre-installed, and the insulating blanket may have attaching tape pre-installed.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semiclosed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A dormer vent covering device comprising:

a dormer vent cover comprising:

a face, wherein the face is sized to cover a portion of an opening of a dormer vent; and a lip extending substantially perpendicularly from a portion of an outer edge of the face, wherein the lip is shaped to correspond to an outer shape of the dormer vent; and an attachment device, wherein the attachment device is detachably attachable to both an interior edge of the dormer vent and the dormer vent cover to attach the dormer vent cover to the dormer vent, wherein the attachment device comprises a clip comprising a first leg and a second leg, wherein the dormer vent is received between the first leg and the second leg, and wherein the second leg comprises a spring that presses the dormer vent against the first leg to fix the attachment device to the dormer vent via a friction fit.

2. The dormer vent covering device of claim 1, wherein the first and second legs extend from a u-shaped hinge.

3. The dormer vent covering device of claim 1, wherein the first leg comprises a fastening device extending substantially perpendicularly from the first leg.

4. The dormer vent covering device of claim 3, wherein the fastening device is a screw.

5. The dormer vent covering device of claim 3, wherein the dormer vent cover has an opening to receive the fastening device.

6. The dormer vent covering device of claim 5 further comprising a fixing device, wherein the fixing device is detachably attached to the fastening device received by the opening on a side of the face opposite the dormer vent.

7. The dormer vent covering device of claim 6, wherein the fixing device is a nut.

8. The dormer vent covering device of claim 1, wherein a weight of the dormer vent cover is supported on the dormer vent via the lip.

9. The dormer vent covering device of claim 1, wherein the dormer vent cover is formed of sheet metal.

10. The dormer vent covering device of claim 1, wherein the dormer vent cover is at least a portion of a circle.

11. The dormer vent covering device of claim 1, wherein the dormer vent cover is a rectangle.

12. The dormer vent covering device of claim 1, wherein the dormer vent cover is sized to leave a lower portion of the dormer vent uncovered.

13. The dormer vent covering device of claim 1 further comprising a screen to cover a portion of the dormer vent not covered by the face.

14. The dormer vent covering device of claim 1 further comprising an insulating panel between the dormer vent and the face.

15. A dormer vent covering device comprising:

a dormer vent cover comprising:

a face, wherein the face is sized to cover a portion of an opening of a dormer vent; and a lip extending substantially perpendicularly from a portion of an outer edge the face, wherein the lip is shaped to correspond to an outer shape of the dormer vent; and an attachment device comprising:

a u-shaped hinge;

a first leg extending from one side of the u-shaped hinge, wherein the first leg comprises a fastening device extending substantially perpendicularly from the first leg; and a second leg extending from the other side of the u-shaped hinge, wherein the second leg comprises a spring, wherein the dormer vent is received between the first leg and the second leg and attached to the attachment device via a friction fit, and wherein the attachment device is detachably attached to the dormer vent cover via the fastening device.

16. The dormer vent covering device of claim 15, wherein the fastening device is a screw.

17. The dormer vent covering device of claim 15 further comprising a fixing device, wherein the dormer vent cover has an opening to receive the fastening device, and wherein the fixing device is detachably attached to the fastening device received by the opening on a side of the face opposite the dormer vent.

* * * * *